US006694940B2

(12) United States Patent
Kawai

(10) Patent No.: US 6,694,940 B2
(45) Date of Patent: Feb. 24, 2004

(54) AIR INTAKE DEVICE HELD BETWEEN DIRECTLY CONNECTED AIR CLEANER CASE AND INTAKE MANIFOLD

(75) Inventor: Yutaka Kawai, Hekinan (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/059,407

(22) Filed: Jan. 31, 2002

(65) Prior Publication Data

US 2002/0104501 A1 Aug. 8, 2002

(30) Foreign Application Priority Data

Feb. 8, 2001 (JP) ..... 2001-32861

(51) Int. Cl.[7] ..... F02M 35/10
(52) U.S. Cl. ..... 123/184.21
(58) Field of Search ..... 123/184.61, 184.21, 123/184.38, 184.53, 336, 337, 198 E, 184.34, 184.46, 184.57

(56) References Cited

U.S. PATENT DOCUMENTS 5,181,491 A * 1/1993 Izumi et al. ..... 123/336
5,967,116 A * 10/1999 Kawashima et al. ..... 123/337
6,334,421 B1 * 1/2002 Singer et al. ..... 123/195 A

FOREIGN PATENT DOCUMENTS

JP A-10-103089 4/1998

* cited by examiner

*Primary Examiner*—Tony M. Argenbright
*Assistant Examiner*—Hyder Ali
(74) *Attorney, Agent, or Firm*—Nixon & Vanderhye P.C.

(57) ABSTRACT

In an air intake device, a throttle body is sandwiched between an air cleaner case and an intake manifold which are connected in direct contact with each other. A gasket for preventing an air leakage is provided between the air cleaner case and the intake manifold radially outside the throttle body. Alternatively, crushable thin projections are provided on the top and the bottom surfaces of the flange. When the flange is sandwiched between the case and the intake manifold, the thin projections are crushed to provide seals therebetween.

14 Claims, 2 Drawing Sheets

AIR INTAKE DEVICE HELD BETWEEN DIRECTLY CONNECTED AIR CLEANER CASE AND INTAKE MANIFOLD

CROSS REFERENCE TO RELATED APPLICATION

This application relates to and incorporated herein by reference Japanese Patent Application No. 2001-32861 filed on Feb. 8, 2001.

FIELD OF THE INVENTION

The present invention relates to an air intake device mainly used for an air intake system of an internal combustion engine for a vehicle.

BACKGROUND OF THE INVENTION

As shown in FIG. 3, an air intake device proposed in JP-A-10-103089 has a metallic throttle body 103 and a resinous air intake duct 104. The throttle body 103 rotatably supports a throttle valve 101 through a valve shaft 102. The air intake duct 104 defines a hollow cylindrical air intake passage 105. The air intake duct 104 has an opening 104*a* that opens in a peripheral direction thereof, and the throttle body 103 is assembled onto the opening 104*a*. O-rings 110 are provided between contact surfaces of the throttle body 103 and the air intake duct 104.

In this kind of air intake device, in addition to the air intake duct, separate sealing members are required at an upstream side and a downstream side of the throttle to prevent an air leakage and communication with the outside air. Further, the throttle body is fixed with bolts. Therefore, the air intake device is upsized, and the number of components is increased. As a result, it is difficult to reduce a manufacturing cost. Furthermore, it is difficult to improve fuel efficiency due to weight increase and upsizing.

SUMMARY OF THE INVENTION

The present invention is made in view of the above problems, and it is an object to provide an air intake device suitable for reducing a manufacturing cost by downsizing and reductions of the numbers of assembly process and components, and reducing a weight by reducing an axial length of a throttle body, so that fuel efficiency of an engine is improved.

According to the present invention, a throttle body is directly connected to an air cleaner case and an intake manifold. Therefore, an air intake duct is not required, and it is unnecessary to fix the throttle body with bolts. Accordingly, the air intake device is downsized and the number of components is reduced.

BRIEF DESCRIPTION OF THE DRAWINGS

Other objects, features and advantages of the present invention will become more apparent from the following detailed description made with reference to the accompanying drawings, in which.

DETAILED DESCRIPTION OF PREFERRED EMBODIMENTS (First Embodiment)

Figure 1:
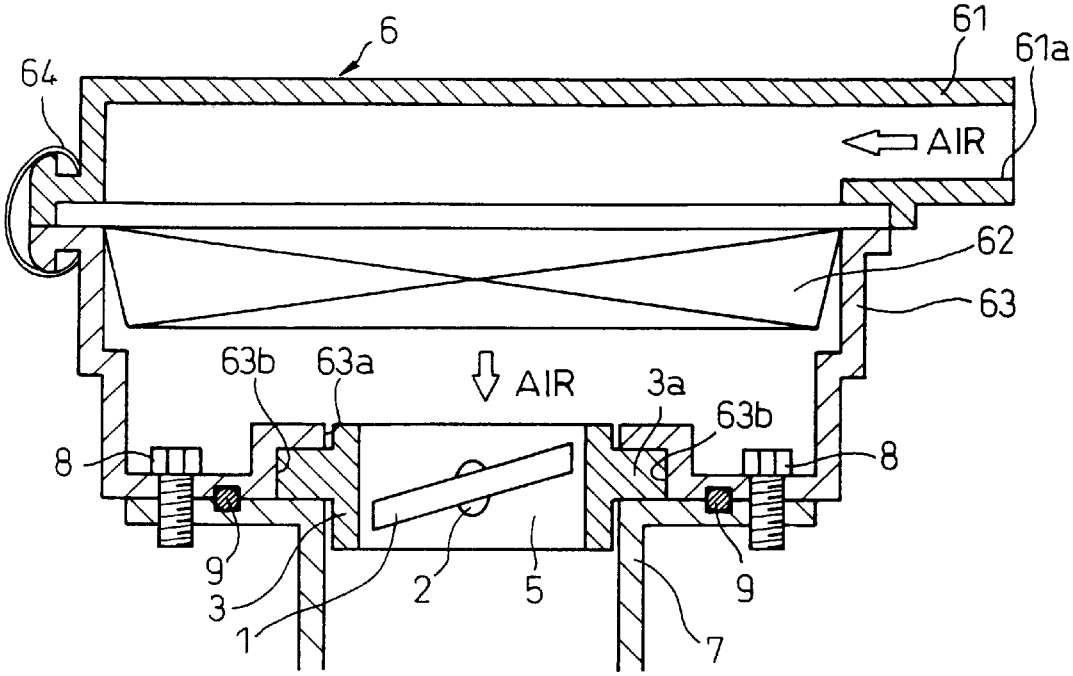
FIG. 1 is a vertical cross-sectional view of an air intake device according to the first embodiment of the present invention.

In an air intake device shown in FIG. 1, a throttle valve 1 is rotatably supported in a throttle body 3 through a valve shaft 2. An accelerator lever (not shown) is provided on an end of the valve shaft 2 that penetrates to the outer peripheral surface of the throttle body 3, and a return spring (not shown) is attached on the valve shaft 2 between the accelerator lever and the throttle body 3. Further, a wire (not shown) interlocked to an accelerator is wound around the accelerator lever. Therefore,the throttle valve 1 is opened/closed by pressing the accelerator. The throttle body 3 has a cylindrical part and an annular flange 3*a* is provided on the outer periphery of the cylindrical part. The throttle body 3 is generally made of metal, such as iron and aluminum alloy, but it may be alternatively made of resin.

An air cleaner unit 6 is provided at the upstream air side of the throttle valve 1. The air cleaner unit 6 has an air cleaner cap 61, an air cleaner element 62 and an air cleaner case 63. The air cleaner element 62 is held between the air cleaner cap 61 and the air cleaner case 63, and the cap 61 and the case 63 are tightened with clamps 64. An air inlet 61*a* is provided in the air cleaner cap 61 and an air outlet 63*a* is provided on the bottom surface of the air cleaner case 63. Further, an annular receiving recess 63*b* for receiving the flange 3*a* of the throttle body 3 is provided on the bottom surface of the air cleaner case 63.

An intake manifold 7 is provided at the downstream air side of the throttle valve 1. Air introduced from the air inlet 61*a* of the air cleaner cap 61 passes through and is filtered by the air cleaner element 62. Then, the air is introduced from the air outlet 63*a* to the intake manifold 7 through the throttle valve 1. In this way, an air passage 5 is formed.

The throttle body 3 is sandwiched between the air cleaner case 63 and the intake manifold 7 and engaged with the both. The air cleaner case 63 and the intake manifold 7 are directly fixed by bolts 8 and the like. The throttle body 3 is detachable. In FIG. 1, the flange 3*a* of the throttle body 3 is sandwiched between the air cleaner case 63 and the intake manifold 7, and the cylindrical part of the throttle body 3 is held on the inner peripheries of the air cleaner case 63 and the intake manifold 7. In this case, an outer diameter of the cylindrical part of the throttle body 3 is smaller than an inner diameter of the intake manifold 7 and a diameter of air outlet 63*a*. In this embodiment, however, the cylindrical part of the throttle body 3 may be directly sandwiched between the air cleaner case 63 and the intake manifold 7 without the flange 3*a*. Although the receiving recess 63*b* for receiving the flange 3*a* is provided at the air cleaner case 63 side, a receiving recess can be provided at the intake manifold 7 side. Further, receiving recesses can be provided on both of the air cleaner case 63 and the intake manifold 7 to jointly receive the flange 3*a*.

In order to prevent air leakage, an annular gasket 9 is sandwiched between contact surfaces of the air cleaner case 63 and the intake manifold 7 radially outside the throttle body 3.

(Second Embodiment)

Figure 2A:
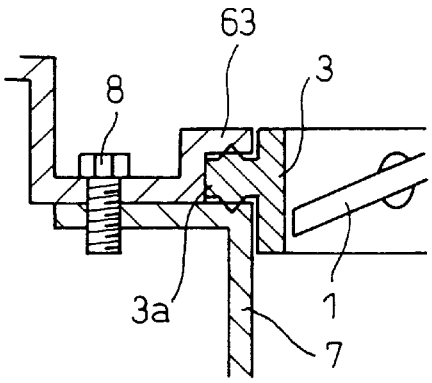
FIG. 2A is a partial vertical cross-sectional view of an air intake device according to the second embodiment of the present invention.
Figure 2B:
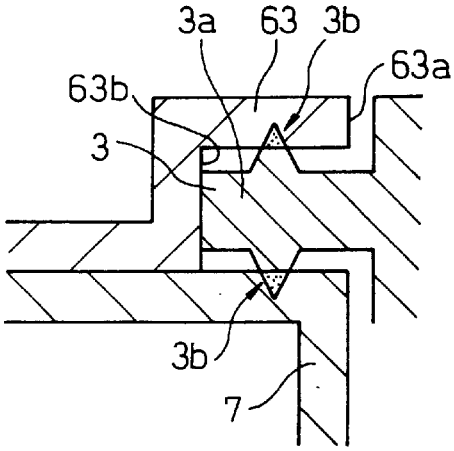
FIG. 2B is a partial enlarged view of a flange shown in FIG. 2A.
Figure 3:
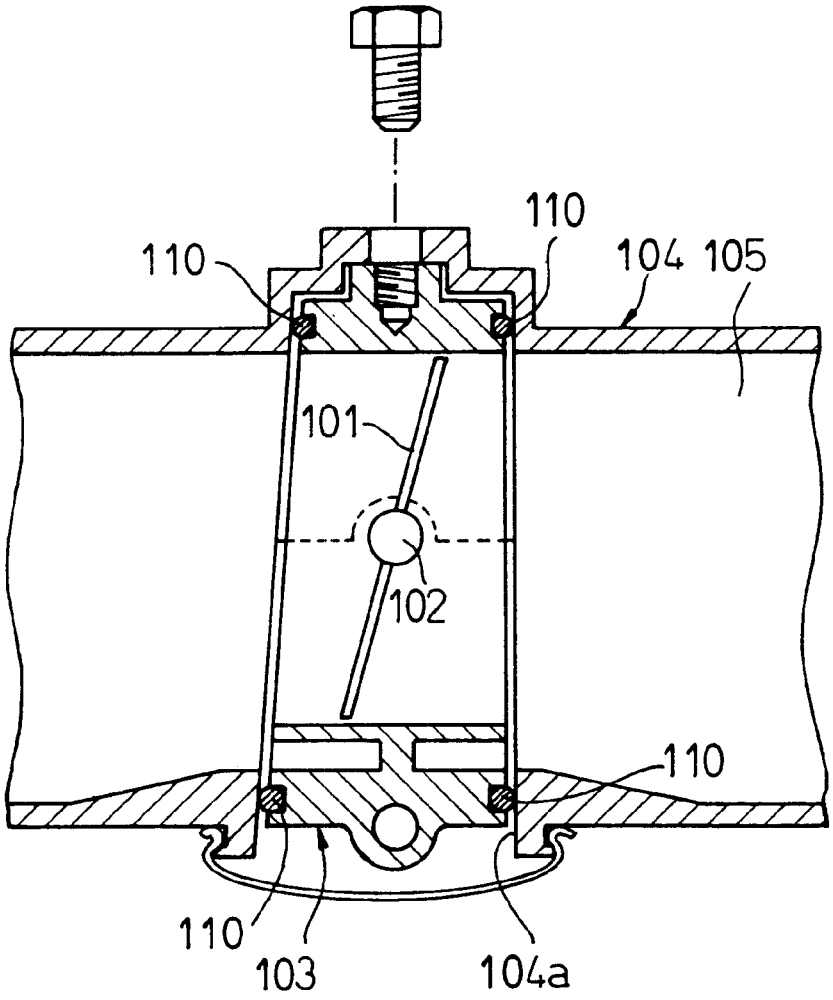
FIG. 3 PRIOR ART
FIG. 3 is a vertical cross-sectional view of a conventional air intake device.

As shown in FIGS. 2A and 2B, annular thin projections 3*b* are provided on both of the top and bottom surfaces of the annular flange 3*a* of the throttle body 3. Each thin projection 3*b*, for example, has a triangular shape in a cross section, as shown in FIG. 2B. When the flange 3*a* of the throttle body 3 is directly held between the air cleaner case 63 and the intake manifold 7, a peak of the thin projection 3*b* is crushed to form sealing portion. In this case, a sealing member such as the gasket 9 of the first embodiment is not required. Although the thin projections are provided on the top and the bottom surfaces of the flange 3*a*, the thin projections can be provided on the air cleaner 6 side and the intake manifold 7 side.

As described above, since the gasket 9 is sandwiched between the air cleaner case 63 and the intake manifold 7 outside the throttle body 3, it is possible to seal the air cleaner case 63 and the intake manifold 7 with a single gasket. Therefore, a manufacturing cost can be reduced. Further, when the throttle body 3 is sandwiched between the air cleaner case 63 and the intake manifold 7, the sealing portions are provided by the crush of the thin projections 3*b* on the throttle body 3, or the air cleaner case 63 and the intake manifold 7. Therefore, a separate sealing member is not required. As a result, the manufacturing cost can be reduced.

Further, since the intake manifold 7 is directly tightened to the air cleaner case 63 with the bolts 8 and the throttle body 3 is sandwiched therebetween, it is not required to tight the throttle body 3 to the intake manifold 7 with bolts. Therefore, the numbers of assembly process and components such as the sealing member and the intake duct are reduced. Accordingly, it is possible to reduce the manufacturing cost.

In addition, since the throttle body 3 has the flange 3*a* and the cylindrical part is held radially inside of the air cleaner case 63 and the intake manifold 7, the outer diameter of the throttle body 3 and the axial length thereof may be reduced. Accordingly, the air intake device is reduced in weight and size. As a result, fuel efficiency of an engine is improved.

The present invention should not be limited to the disclosed embodiments, but may be implemented in other ways without departing from the spirit of the invention.

What is claimed is:

1. An air intake device for an engine comprising an air cleaner case;

an intake manifold; and a throttle body directly connected to the air cleaner case and the intake manifold, the throttle body having a flange on an outer periphery of a cylindrical part thereof, the flange being sandwiched between the air cleaner case and the intake manifold, wherein the air cleaner case and the intake manifold are directly connected to each other, and at least one of the air cleaner case and the intake manifold provides a recess portion for receiving the flange of the throttle body.

2. An air intake device for an engine comprising an air cleaner case;

an intake manifold; and a throttle body directly connected to the air cleaner case and the intake manifold, the throttle body having a flange on an outer periphery of a cylindrical part thereof, the flange being sandwiched between the air cleaner case and the intake manifold, wherein an outer diameter of the cylindrincal part of the throttle body is smaller than an inner diameter of the intake manifold, and the cylindrical part of the throttle body is held inside the air cleaner case and the intake manifold.

3. An air intake device for an engine comprising an air cleaner case;

an intake manifold; and a throttle body directly connected to the air cleaner case and the intake manifold, the throttle body having a flange on an outer periphery of a cylindrical part thereof, the flange being sandwiched between the air cleaner case and the intake manifold; and a sealing structure for sealing at least one of between the throttle body and the air cleaner case and between the throttle body and the intake manifold, wherein the sealing structure has a projection which is crushable when the throttle body is sandwiched between the air cleaner case and the intake manifold.

4. The air intake device according to claim 3, wherein the projection has a substantially triangular shape in cross section before being crushed.

5. An air intake device for an engine comprising an air cleaner case;

an intake manifold;

a throttle body directly connected to the air cleaner case and the intake manifold, the throttle body having a flange on an outer periphery of a cylindrical part thereof, the flange being sandwiched between the air cleaner case and the intake manifold; and a sealing structure for sealing at least one of between the throttle body and the air cleaner case and between the throttle body and the intake manifold, wherein the sealing structure is provided on the throttle body at a part which contacts at least one of the air cleaner case and the intake manifold.

6. An air intake device for an engine comprising an air cleaner case;

an intake manifold;

a throttle body directly connected to the air cleaner case and the intake manifold, the throttle body having a flange on an outer periphery of a cylindrical part thereof, the flange being sandwiched between the air cleaner case and the intake manifold; and a sealing structure for sealing at least one of between the throttle body and the air cleaner case and between the throttle body and the intake manifold, wherein the flange of the throttle body has a first surface facing the air cleaner case and a second surface facing the intake manifold, and the sealing structure is provided on at least one of the first and second surfaces.

7. An air intake device for an engine comprising an air cleaner case;

an intake manifold;

a throttle body directly connected to the air cleaner case and the intake manifold, the throttle body having a flange on an outer periphery of a cylindrical part thereof; the flange being sandwiched between the air cleaner case and the intake manifold; and a sealing structure for sealing at least one of between the throttle body and the air cleaner case and between the throttle body and the intake manifold, wherein the sealing structure is provided on at least one of the air cleaner case and the intake manifold at a part which contacts the flange of the throttle body.

8. An air intake device comprising:

an air cleaner case having an air cleaner element for filtering air;

an intake manifold provided at a downstream air side of the air cleaner case; and a throttle body having a cylindrical part, a throttle shaft and a throttle valve, the throttle valve being rotatably supported in the cylindrical part through the throttle shaft, wherein the cylindrical part of the throttle body has an outer diameter smaller than an inner diameter of an air outlet of the air cleaner case and an inner diameter of the intake manifold, and is held by the air cleaner case and the intake manifold radially inside the air cleaner case and the intake manifold.

9. The air intake device according to claim 8, wherein the air cleaner case is connected to the intake manifold in direct contact with the air cleaner case, and wherein the throttle body has an annular flange on the cylindrical part, and the flange is sandwiched between the air cleaner case and the intake manifold.

10. The air intake device according to claim 9, wherein at least one of the air cleaner case and the intake manifold has a recess for receiving the flange of the throttle body therein.

11. The air intake device according to claim 8, further comprising:

an annular gasket provided between the air cleaner case and the intake manifold radially outside the throttle body.

12. The air intake device according to claim 8, wherein the air cleaner case and the intake manifold are directly fixed to each other while holding the throttle body.

13. An air intake device comprising:

an air cleaner case having an air cleaner element for filtering air;

an intake manifold provided at a downstream air side of the air cleaner case; and a throttle body having a cylindrical part, a throttle shaft and a throttle valve, the throttle valve being rotatably supported in the cylindrical part through the throttle shaft, the cylindrical part of the throttle body having a smaller diameter than the air cleaner case and the intake manifold, and is held radially inside the air cleaner case and the intake manifold, wherein the air cleaner case is connected to the intake manifold in direct contact with the air cleaner case, and wherein the throttle body has an annular flange on the cylindrical part, and the flange is sandwiched between the air cleaner case and the intake manifold, wherein the flange has a first surface contacting the air cleaner case and a second surface contacting the intake manifold, and at least one of the first and the second surfaces of the flange has an annular projection which is crushable when the throttle body is sandwiched between the air cleaner case and the intake manifold.

14. An air intake device comprising:

an air cleaner case having an air cleaner element for filtering air;

an intake manifold provided at a downstream air side of the air cleaner case; and a throttle body having a cylindrical part, a throttle shaft and a throttle valve, the throttle valve being rotatably supported in the cylindrical part through the throttle shaft, the cylindrical part of the throttle body having a smaller diameter than the air cleaner case and the intake manifold, and is held radially inside the air cleaner case and the intake manifold, wherein the air cleaner case is connected to the intake manifold in direct contact with the air cleaner case, and wherein the throttle body has an annular flange on the cylindrical part, and the flange is sandwiched between the air cleaner case and the intake manifold, wherein at least one of the air cleaner case and the intake manifold has a projection on a surface which contacts the flange, and the projection is crushable when the flange is sandwiched by the air cleaner case and the intake manifold.

* * * * *